US010760876B2

(12) United States Patent
Meares, IV

(10) Patent No.: US 10,760,876 B2
(45) Date of Patent: Sep. 1, 2020

(54) CLARITY SIGHTING SYSTEM AND EVALUATION METHOD

(71) Applicant: William Murray Meares, IV, Huntington Beach, CA (US)

(72) Inventor: William Murray Meares, IV, Huntington Beach, CA (US)

( * ) Notice: Subject to any disclaimer, the term of this patent is extended or adjusted under 35 U.S.C. 154(b) by 26 days.

(21) Appl. No.: 16/294,638

(22) Filed: Mar. 6, 2019

(65) Prior Publication Data

US 2019/0277599 A1 Sep. 12, 2019

Related U.S. Application Data

(60) Provisional application No. 62/639,421, filed on Mar. 6, 2018.

(51) Int. Cl.

| | |
|---|---|
| ***F41G 1/01*** | (2006.01) |
| ***F41G 1/54*** | (2006.01) |
| ***F41G 1/06*** | (2006.01) |
| ***F41G 1/02*** | (2006.01) |

(52) U.S. Cl.

CPC ..... *F41G 1/01* (2013.01); *F41G 1/02* (2013.01); *F41G 1/06* (2013.01); *F41G 1/54* (2013.01)

(58) Field of Classification Search

CPC ... F41G 1/01; F41G 1/54; F41G 1/545; F41G 1/02; F41G 1/06

USPC ..... 42/111, 133, 140, 148, 106, 144, 145

See application file for complete search history.

(56) References Cited

U.S. PATENT DOCUMENTS

| | | | | |
|---|---|---|---|---|
| 404,599 | A * | 6/1889 | Carver | F41G 1/17 42/140 |
| 843,145 | A * | 2/1907 | Gunn | F41G 1/17 42/140 |
| 1,586,413 | A * | 5/1926 | Doornbos | F41G 1/17 42/140 |
| 3,698,092 | A | 10/1972 | Rosenhan | |
| 3,834,035 | A | 9/1974 | Merrill | |
| 3,984,917 | A | 10/1976 | Korzeniewski | |
| 5,878,503 | A | 3/1999 | Howe et al. | |
| 7,296,376 | B2 * | 11/2007 | Kidd | F41G 1/02 42/111 |
| 7,726,229 | B2 * | 6/2010 | Schwerman | F41G 1/17 42/125 |
| 7,743,546 | B2 * | 6/2010 | Keng | F41G 11/003 42/113 |
| 8,069,607 | B2 * | 12/2011 | Ballard | F41G 1/033 42/111 |

(Continued)

*Primary Examiner* — Jonathan C Weber

(74) *Attorney, Agent, or Firm* — Charles Runyan

(57) ABSTRACT

An improved clarity sighting system; the improved clarity sighting system includes a collection of front and rear firearm sights, and a gauge tool having mock front and rear sights representing each of the genuine front and rear sights. The gauge tool simulates sight pictures formed by the alignment of the mock front and rear sights. Each of the mock-front-sights corresponds to and replicates the size and shape one of the genuine front-sights, and each of the mock-rear-sights corresponds to and replicates the size and shape of one of the genuine rear-sights. In this way, a user may visually determine which combination of each of the plurality of front-sights and each of plurality of rear-sights matches the user's vision. Each of the genuine front and rear sights are enlarged and are tapered on each face towards the muzzle of then firearm in order to enhance clarity.

7 Claims, 5 Drawing Sheets

(56) References Cited

U.S. PATENT DOCUMENTS

| | | | | |
|---|---|---|---|---|
| 9,328,993 | B1 | 5/2016 | Heacock | |
| 2006/0207157 | A1* | 9/2006 | Keng | F41G 1/32 42/132 |
| 2007/0234625 | A1* | 10/2007 | Kidd | F41G 1/28 42/111 |

* cited by examiner

CLARITY SIGHTING SYSTEM AND EVALUATION METHOD

CROSS-REFERENCE TO RELATED APPLICATION(S)

The present application is related to and claims priority to U.S. Provisional Patent Application No. 62/639,421 filed Mar. 6, 2018, which is incorporated by reference herein in its entirety.

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

TECHNICAL FIELD

The present invention relates generally to the field of firearms of existing art and more specifically relates to firearm sighting systems.

RELATED ART

Modern firearms are highly precise machines capable of firing projectiles at range with extreme accuracy. Generally, the difficulty in shooting a firearm to it's best potential has to do with a shooter's ability to interface with the firearm, and not the inherent mechanical accuracy of the firearm. One of the primary challenges in shooting a firearm accurately is using the sights to visually align the gun with the projectile's trajectory. Handguns are one of the most difficult firearms to aim, due to the small size and simplicity of the iron sights. Further difficulty comes when people having myopia or other forms of visual degradation attempt to use iron sights. Shooters with visual problems often cannot see iron sights clearly enough to shoot accurately. Even in cases where corrective lenses are an option, sometimes the interference of those lenses prevents the proper focusing of the front sight, rear sight, and target simultaneously. Some such users are forced to resort to electronic or optical sighting systems, but these are not practical in all applications, particularly handguns. A suitable solution is desired.

U.S. Pat. No. 9,328,993 to Lee Philip Heacock relates to a gun sight. The described gun sight includes a gun sight having a rear sight including at least two apertures which are offset vertically and horizontally to correctly sight the gun relative to two perpendicular axes. A forward sight is also provided which corresponds to the at least first and second apertures of the rear sight. These features also offset vertically and horizontally to aid in fast acquisition and targeting. The user or shooter may learn to accurately fire the weapon and more easily acquire a target with less extensive training.

SUMMARY OF THE INVENTION

In view of the foregoing disadvantages inherent in the known firearm sighting systems art, the present disclosure provides a novel improved clarity sighting system and evaluation method. The general purpose of the present disclosure, which will be described subsequently in greater detail, is to provide an improved clarity sighting system and evaluation method.

An improved clarity sighting system is disclosed herein. The improved clarity sighting system includes a collection of front and rear firearm sights, and a gauge tool having mock front and rear sights representing each of the genuine front and rear sights. The gauge tool simulates sight pictures formed by the alignment of the mock front and rear sights. Each of the mock-front-sights corresponds to and replicates the size and shape one of the genuine front-sights, and each of the mock-rear-sights corresponds to and replicates the size and shape of one of the genuine rear-sights. In this way, a user may visually determine which combination of each of the plurality of front-sights and each of plurality of rear-sights matches the user's vision.

According to another embodiment, a method of selecting a sight set for a firearm is also disclosed herein. The method of selecting a sight set for a firearm includes providing the above-described improved clarity sighting system, aligning one of the mock-front-sights and one of the mock-rear-sights of the tool to form a sight picture; repeating the alignment with differing combinations of the mock-front-sights and the rear-mock-sights; choosing which of the combinations of one of the mock-front-sights and one of the mock-rear-sights provide the sharpest sight picture; and selecting a set of firearm sights which correspond to the one of the mock-front-sights and the one of the mock-rear-sights chosen.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, an improved clarity sighting system and evaluation method, constructed and operative according to the teachings of the present disclosure.

The various embodiments of the present invention will hereinafter be described in conjunction with the appended drawings, wherein like designations denote like elements.

DETAILED DESCRIPTION

Figure 1:
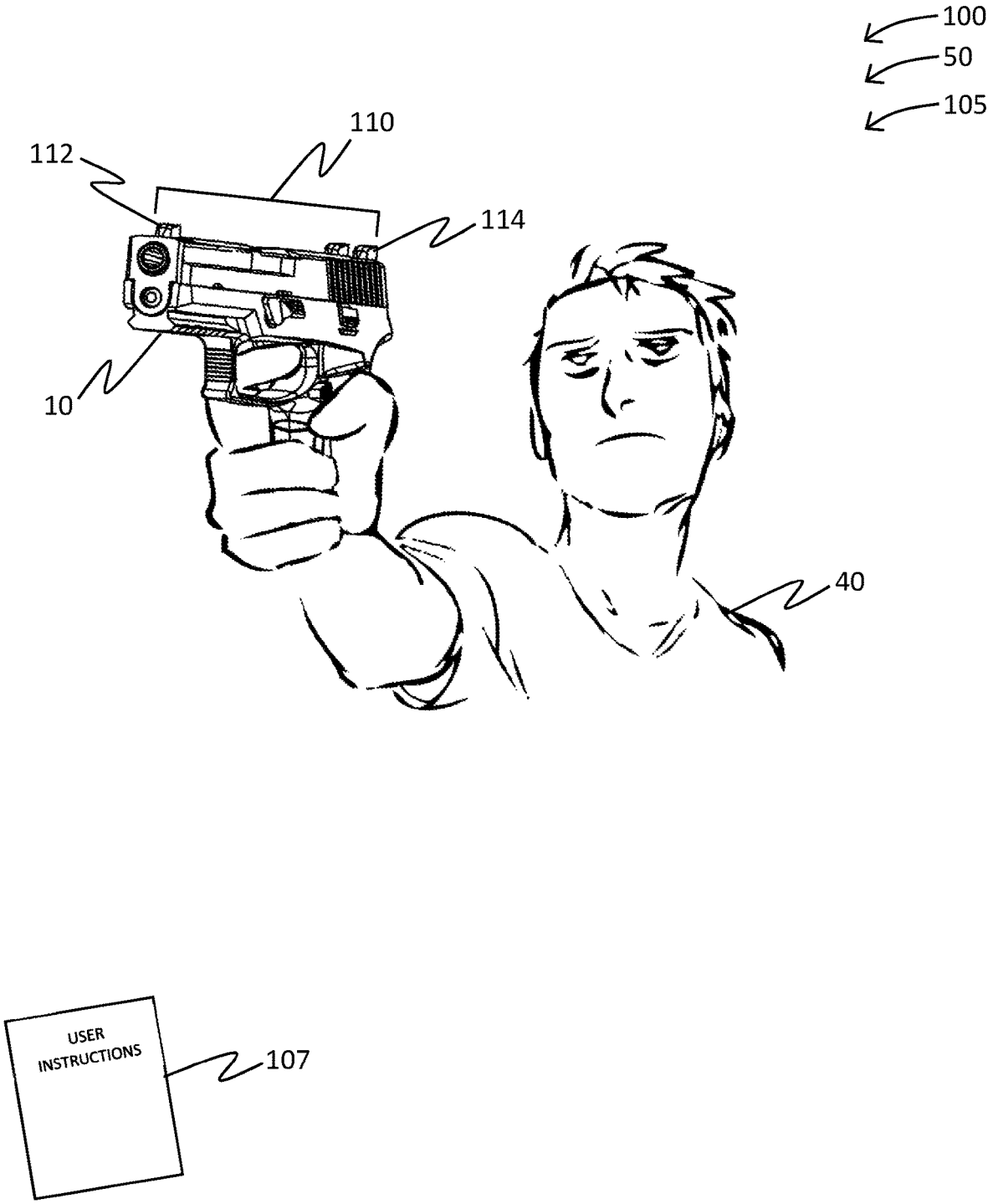
FIG. 1 is a perspective view of the system with a firearm during an 'in-use' condition, according to an embodiment of the disclosure.

As discussed above, embodiments of the present disclosure relate to a firearm sighting system and more particularly to an improved clarity sighting system and evaluation method as used to improve the clarity and effectiveness of acquisition and aiming of firearm sights.

Generally, the system is a weapons sighting system that involves a vision evaluation system, by which the result of the evaluation can be used to select a physical sight intended to compensate for near vision acuity loss in the shooter. Results of the evaluation system correspond to a selection of sights having varying dimensions and structural characteristics tailor-fit to the visual needs of the shooter. The system includes an apparatus. The apparatus is a vision assessment tool, wherein the result of the evaluation is correlated to the configuration of several customizable aspects of a physical sight that will be mounted onto a projectile firing device (e.g., firearm, etc.). The physical sights comprise mechanical sights, generally referred to as iron sight, and include a front sight and a rear sight. In one exemplary embodiment, the iron sights are open U-notch sights for a handgun. Alternative sight types may be incorporated, and various materials may be used. A further apparatus provided by the present system is the set of iron sights themselves, which are permanently or impermanently affixed to the firearm, and are selected based upon the results of the vision evaluation tool and process. Some examples from the selection of sights are front and rear sight elements that are up to five times larger (e.g., wider, taller, thicker, etc.) than standard or traditional sights. Also, the system allows for the configuration of sight parameters that include, but are not limited to; (a) the size of the each sight post (b) the relative proportion of the size of the front sight post when compared to the size rear sight posts (c) the relative proportion of the size of the notch in the rear sight and the resulting visual gap between the front sight post and the rear sight notch as created by perspective when viewed for the purpose of aligning the projectile firing device on a target. Sight components are preferably shaped such that only the front facing planes of the front and rear sight are visible to the shooter. The size of each the front sight post and the rear sight posts can be varied to accommodate varying shooter acuity, the distance available between the front sight and the rear sight, and shooter preference. This adjustment is made by physically increasing the size of the front post and rear sight posts as well as the size of the notch in the center of the rear sight posts. The sizes of all elements can be adjusted in order to optimize the sight picture as correlated to near vision acuity of an individual shooter. Once optimized, a permanent sighting system may be selected and used based upon the optimization. The size of the gap between the sides of the front sight post and the interior sides of the rear sight posts when aligned can be varied by widening or narrowing the front sight post and/or widening or narrowing the gap between the rear sight posts to accommodate (a) varying shooter acuity, (b) the distance available between the front sight and the rear sight, and (c) shooter preference. This adjustment is made by physically increasing the size of the front post and rear sight posts as well as the size of the notch in the center of the rear blade. The blur that may be inherent in some eyesight is offset and absorbed/diminished by optimization of the physical size of the sight posts, along with the size of the gap between the front post and the rear blade when observed in alignment by the shooter. In addition, the front post and rear blade of sight are shaped such that only the face of the sight available to the shooter can be seen by the shooter. To this end, each part of the sights may be tapered, and tapered such that they narrow towards the front or muzzle of the weapon. This ensures a crisp sight picture. The opposite side of the sight is tapered away from the shooter such that that no side face of the front or rear blade can be seen by the shooter. This eliminates disadvantageous visual elements and side effects that are not easily discerned with reduced vision acuity and that are not needed for sight alignment.

The vision evaluation tool can be a physical device that allows for the comparison of various distances between the sight, size of the sights, relative proportions of the size and configuration of these elements on the visual sight picture. The vision evaluation tool may be an assessment that is conducted or recorded via computer or hard copy material that evaluates near vision capability in order to configure an appropriate match sighting configuration that will optimize the sight picture according to the results of the evaluation. The features of the invention which are believed to be novel are particularly pointed out in the specification. The evaluation tool now will be described more fully hereinafter with reference to the accompanying drawings, which are intended to be read in conjunction with both this summary, the detailed description and any preferred and/or particular embodiments specifically discussed or otherwise disclosed. This invention may, however, be embodied in many different forms and should not be construed as limited to the embodiments set forth herein; rather, these embodiments are provided by way of illustration only and so that this disclosure will be thorough, complete and will fully convey the full scope of the invention to those skilled in the art.

The evaluation tool may be a test device including replicas, fixtures, molds, or attachments of various front and rear sights in alignment with each other, enabling individuals to examine the sizes and shapes of each front and rear sight to determine which combination best suits his/her needs and vision.

In a preferred embodiment, the evaluation tool includes a mount, and a plurality of sight sets which correspond to actual sight sights which may be selected and fitted to a weapon. The evaluation tool provides users with the opportunity to compare many sight variations to each other without the need to handle a weapon or affix sights to a weapon.

In this arrangement, each of the front sight and the rear sight are rotatable in relation to the body, with the body being affixable to a firearm. This arrangement may allow for evaluation purposes such that the shooter may find the best combination in order to affix a more permanent sighting system that best suits shooter to improve accuracy. In alternative embodiments, other types of gauge tools may be used to the same end. For example, one gauge tool may merely be a printed medium on a planar surface such as the side of a box, a pamphlet, an index card, or others. Preferably, representations of each of the front sights and each of the rear sights are printed with precise replication of the size and shape of each of the front sights and each of the rear sights. Additionally, the printed medium may also show various combinations of each of the front sights and each of the rear sights to show prospective sight pictures corresponding to that combination. Yet other gauge tool solutions may be implemented, provided that they enable a user to preview each of the front sights and each of the rear sights, with suitable representation such that a user can determine which combination works best with his or her vision. The exact specifications, materials used, and method of use of the adjustable firearm sighting system may vary upon manufacturing. It should be noted that for the purposes of this specification and the claims, it should be understood that "forward" indicates towards a muzzle of a gun; "rearward" indicates the opposite of "forward", "inward" indicates towards an interior or center of a firearm sight; and "outward" indicates the opposite of "inward".

Referring now more specifically to the drawings by numerals of reference, there is shown in FIGS. 1-4, various views of a system 100. FIG. 1 shows a system 100 during an 'in-use' condition 50, according to an embodiment of the present disclosure. Here, the system 100 may be beneficial for use by a user 40 to select and provide an optimized mechanical sighting system for a shooter. System 100 may include a collection of firearms sights 110 including front-sights 112 and rear-sights 114. Each of front-sights 112 and rear-sights 114 may be mountable on firearm 10. According to one embodiment, the system 100 may be arranged as a kit 105. In particular, the system 100 may further include a set of instructions 107. The instructions 107 may detail functional relationships in relation to the structure of the system 100 such that the system 100 can be used, maintained, or the like, in a preferred manner.

Figure 2:
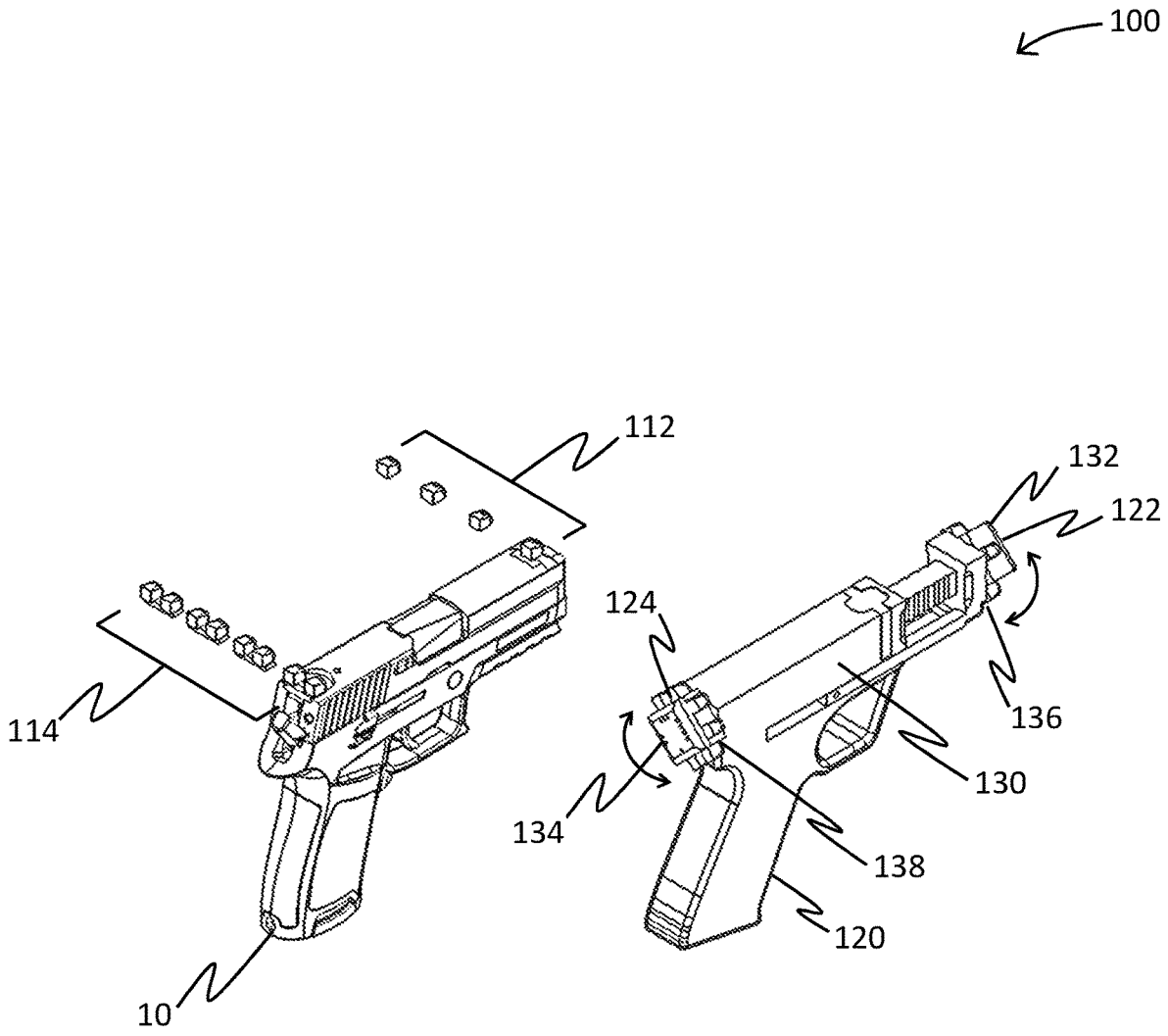
FIG. 2 is a perspective view of the system of FIG. 1 with the gauge tool being used to select and install sights on a firearm, according to an embodiment of the present disclosure.

FIG. 2 shows the system 100 of FIG. 1, according to an embodiment of the present disclosure. System 100 further comprises gauge tool 120 able to simulate a sighting arrangement on firearm 10. Gauge tool 120 includes plurality of mock-front-sights 122 and plurality of mock-rear-sights 124. Each of mock-front-sights 122 corresponds to and replicates the size and shape of at least one of plurality of front-sights 112 belonging to collection of firearm sights 110 (FIG. 1). Likewise, each of mock-rear-sights 124 corresponds to and replicates the size and shape of at least one of plurality of rear-sights 114 belonging to collection of firearm sights 110 (FIG. 1). In this way, user 40 (FIG. 1) is able to visually determine which combination of front-sights 112 and rear-sights 114 matches the user's vision. Each of mock-front-sights 122 and mock-rear-sights 124 may be selectively positionable and alignable such that user 40 (FIG. 1) may try multiple combinations in order to determine which sight picture suits user 40 (FIG. 1) best. Plurality of front-sights 112 preferably consists of four front-sights, each of the four front-sights 112 being of differing sizes. In the same way, plurality of rear-sights 114 preferably consists of four rear-sights, each of the four rear-sights 114 being of differing sizes.

In one embodiment, gauge tool 120 is a planar surface which has visible indicia replicating size and shape of each of plurality of front-sights 112 and each of plurality of rear-sights, such that the user may visually determine which combination of each of plurality of front-sights 112 and each of plurality of rear-sights 114 matches the user's vision. For example, the planar surface may be the back or a blister pack or other packaging, a poster, a flyer, an index card, or others.

In the illustrated embodiment, gauge tool 120 may include elongate body 130, front-sight-array 132, rear-sight-array 134, front-coupling 136, and rear-coupling 138. Front-sight-array 132 may include one or more of plurality of mock-front-sights 122, and rear-sight-array 134 may likewise have one or more of plurality of mock-rear-sights 124. Front-coupling may rotatably connect front-sight-array 132 to elongate body 130. Likewise, rear-coupling 138 may rotatably connect rear-sight-array 134 to elongate body 130. Both front-coupling 136 and rear-coupling 138 may rotate along the same axis, such that each of plurality of mock-front-sights 122 can be selectively aligned to each of plurality of mock-rear-sights 124 by manually rotating at least one of front-sight-array 136 and rear-sight-array 138 relative to elongate body 130. Accordingly, when aligned, a selection of one of plurality of mock-front-sights 122 and one of plurality of mock-rear-sights 124 in combination will convey a sight-picture to user 40 (FIG. 1) indicating an intended point-of-impact. Front-sight-array 132 comprises exactly four of plurality of mock-front-sights 122, such that each of the four of mock-front-sights 122 are integrally connected to each other, and each of four of mock-front-sights 122 are oriented perpendicularly to one another. In the same way, rear-sight-array 134 comprises exactly four of plurality of mock-rear-sights 124, such that each of the four of mock-rear-sights 124 are integrally connected to each other, and each of four of mock-rear-sights 124 are oriented perpendicularly to one another. In the illustrated embodiment, elongate body 130 comprises mock-firearm-frame 139 which simulates the ergonomics of a semi-automatic handgun having a grip and a slide. Front-coupling 136 and rear-coupling 138 rotate along the same axis, such that each of plurality of mock-front-sights 122 can be selectively aligned to each of plurality of mock-rear-sights 124 by manually rotating at least one of the front-sight-array and the rear-sight-array relative to the elongate body. Front-sight-array 132 and rear-sight-array 134 may each comprise detents (not illustrated) configured to retain each one of the plurality of front-mock-sights 122 and each one of the plurality of rear-mock-sights 124 in selective alignment with each other. In an alternative embodiment, elongate body 130 can be removably coupled to a firearm. In yet another embodiment, gauge tool 120 may be digitally generated, and may be displayed via a user interface on a screen.

Figure 3:
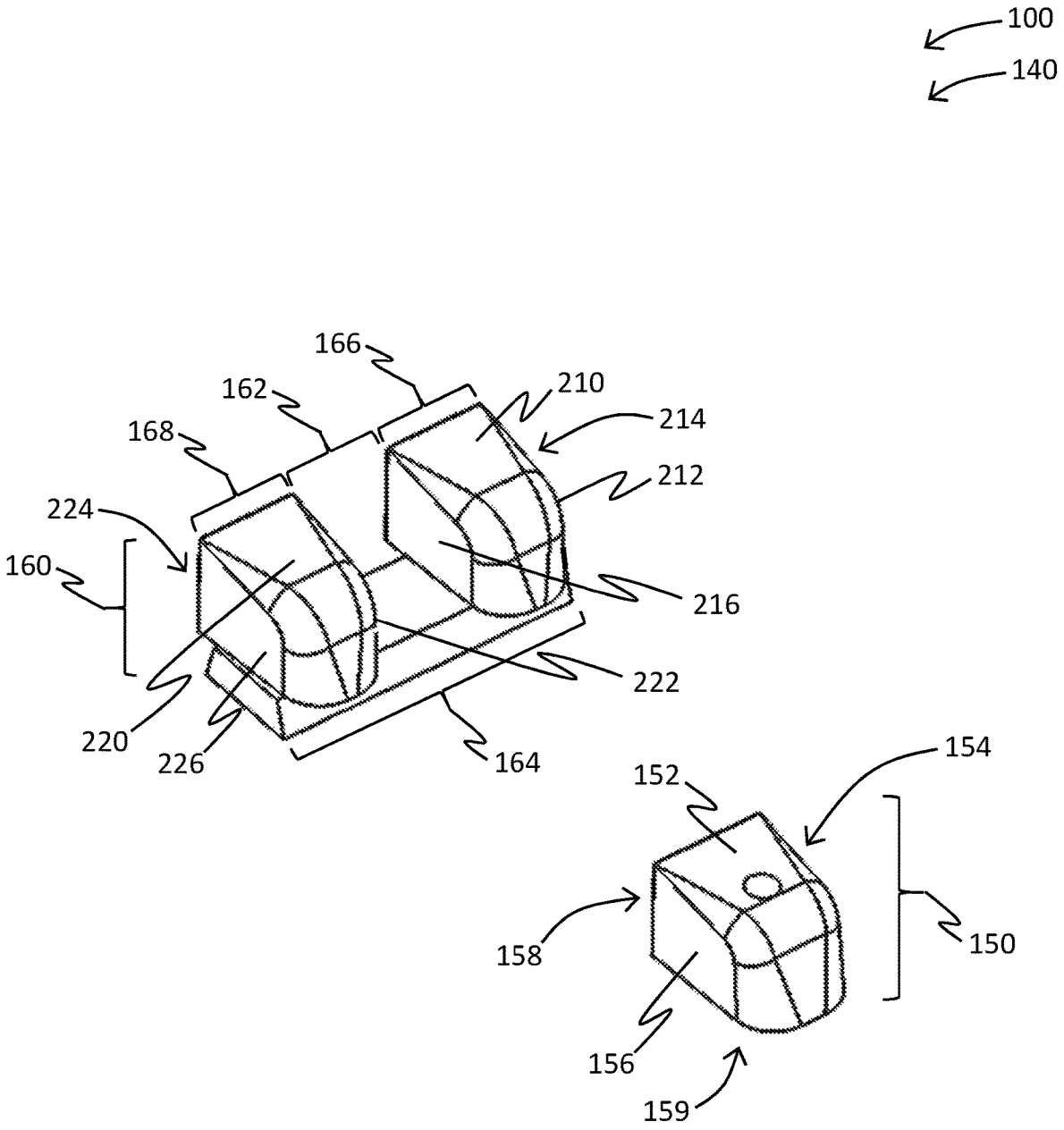
FIG. 3 is a perspective view of one of the pairs of sights of the system of FIG. 1, according to an embodiment of the present disclosure.

FIG. 3 is a perspective view of the collection of sights shown in FIG. 1, according to an embodiment of the present disclosure. Collection of sights 110 (FIG. 1) may include clarified-sight-set 140 as illustrated. Clarified-sight-set 140 may include clarified-front-sight 150 and clarified-rear-sight 160. Clarified-front-sight 150 may include front-sight-top-surface 152, front-sight-left-surface 154, front-sight-right-surface 156, front-sight-rear-surface 158, and front-sight-bottom-surface 159. Front-sight-top-surface 152 may have a downward-forward taper. Front-sight-left-surface 154 may have an inward-forward taper. Front-sight-right-surface 156 may also have an inward-forward taper. Front-sight-bottom-surface 159 may have no taper. The multi-tapered nature of clarified-front-sight 150 may ensure that the edges of clarified-front-sight 150 do not blur, glare, or otherwise produce an unclear sight picture.

Clarified-rear-sight 160 may include u-channel 162 as shown formed by the combination of rear-sight-base 164, left-ear 166, and right-ear 168. Left-ear 166 may include left-ear-top-surface 210, which has a downward-forward taper; left-ear-left-surface 212, which has an inward-forward taper; left-ear-rear-surface 214; and left-ear-right-surface 216, which also has an inward-forward taper. Right-ear 168 may include right-ear-top-surface 220, which has a downward-forward taper; right-ear-left-surface 222, which has an inward-forward taper; right-ear-rear-surface 224; and right-ear-right-surface 226, which also has an inward-forward taper. The multi-tapered nature of clarified-rear-sight 160 may ensure that the edges of clarified-rear-sight 160 do not blur, glare, or otherwise produce an unclear sight picture.

Figure 4:
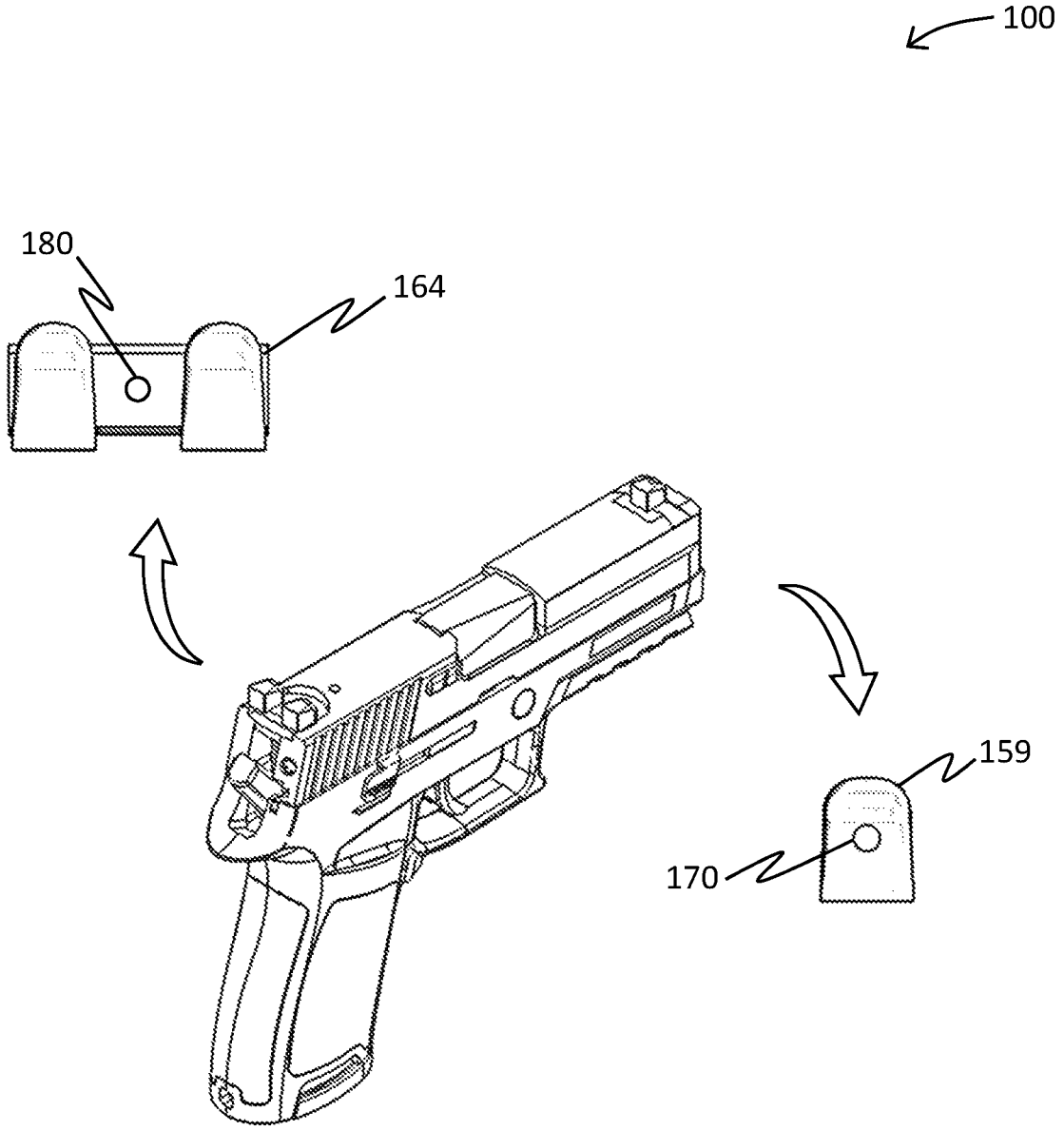
FIG. 4 is a bottom perspective view of the sights of the system of FIG. 1 being installed on a firearm, according to an embodiment of the present disclosure.

FIG. 4 is a perspective view of the clarified sight system 100 of FIG. 3, according to an embodiment of the present disclosure. Front-sight-bottom-surface 159 may include a front-fastening-mechanism 170. Front-fastening-mechanism 170 may be a dovetail, a set-screw, or a machine-screw. Rear-sight-base 164 may further include a rear-fastening-mechanism 180, which may be a dovetail, a set-screw, or a machine-screw.

Figure 5:
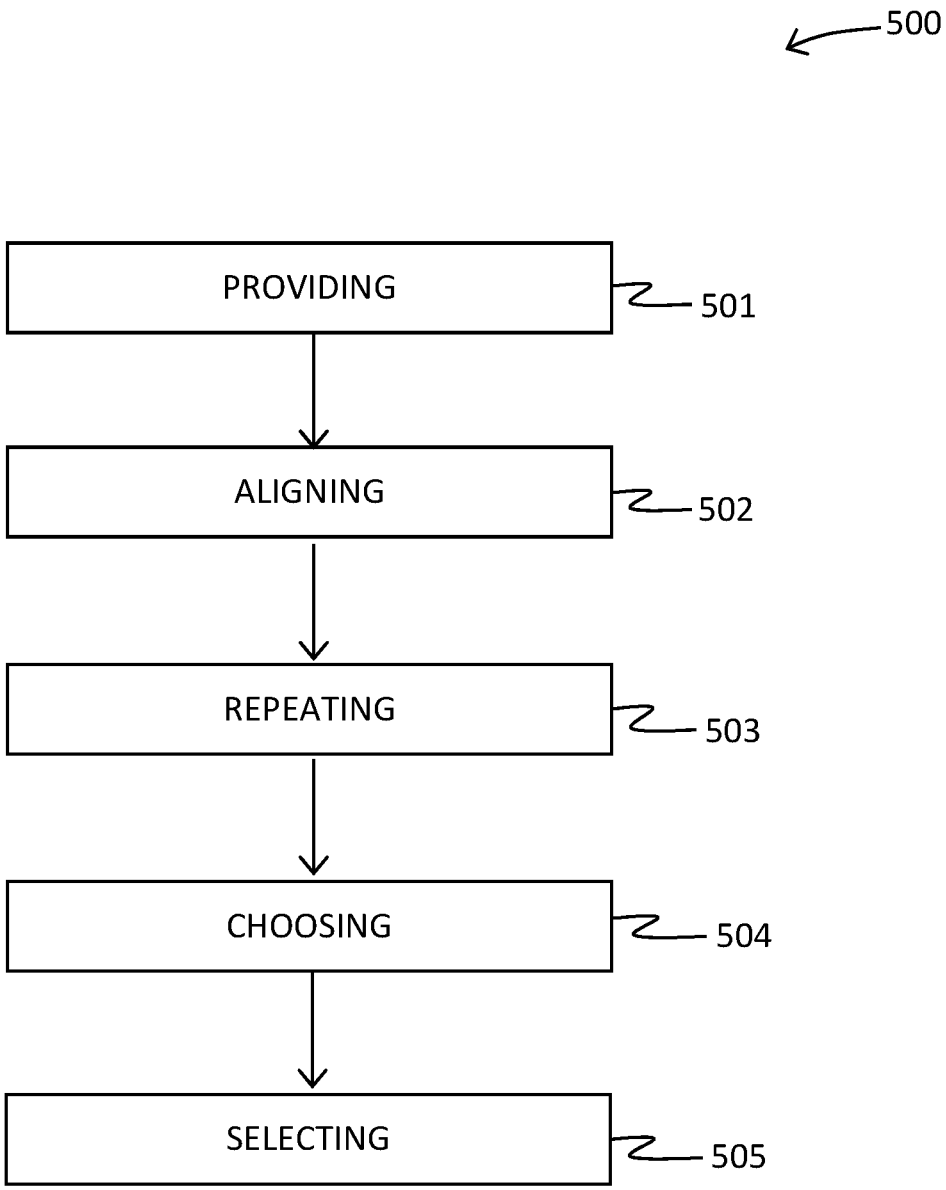
FIG. 5 is a flow diagram illustrating a method of use for selecting and providing an optimized mechanical sighting system for a shooter, according to an embodiment of the present disclosure.

FIG. 5 is a flow diagram illustrating a method for selecting and providing an optimized mechanical sighting system for a shooter 500 according to an embodiment of the present disclosure. In particular, the method for selecting and providing an optimized mechanical sighting system for a shooter 500 may include one or more components or features of the system 100 as described above. As illustrated, the method for selecting and providing an optimized mechanical sighting system for a shooter 500 may include the steps of: step one 501, providing a system for selecting firearm sights, the system comprising a collection of firearm sights comprising a plurality of front-sights; and a plurality of rear-sight; a gauge tool able to simulate a sighting arrangement on a firearm, the gauge tool comprising: a plurality of mock-front-sights; a plurality of mock-rear-sights; wherein each of the mock-front-sights corresponds to and replicates size and shape of at least one of the plurality of front-sights belonging to the collection of firearm sights; and wherein each of the mock-rear-sights corresponds to and replicates size and shape of at least one of the plurality of rear-sights belonging to the collection of firearm sights; such that a user may visually determine which combination of each of the plurality of front-sights and each of plurality of rear-sights matches the user's vision; step two 502, aligning one of the mock-front-sights and one of the mock-rear-sights of the tool to form a sight picture; step three 503, repeating the alignment with differing combinations of the mock-front-sights and the rear-mock-sights; step four 504, choosing which of the combinations of one of the mock-front-sights and one of the mock-rear-sights provide the sharpest sight picture; and step 505, selecting a set of clarified firearm sights corresponding to the one of the mock-front-sights and the one of the mock-rear-sights chosen.

It should be noted that the steps described in the method of use can be carried out in many different orders according to user preference. The use of "step of" should not be interpreted as "step for", in the claims herein and is not intended to invoke the provisions of 35 U.S.C. § 112(f). It should also be noted that, under appropriate circumstances, considering such issues as design preference, user preferences, marketing preferences, cost, structural requirements, available materials, technological advances, etc., other methods for selecting and providing an optimized mechanical sighting system for a shooter, are taught herein.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A system for selecting firearm sights, the system comprising:

a collection of firearm sights comprising
a plurality of front-sights; and
a plurality of rear-sight;

a gauge tool able to simulate a sighting arrangement on a firearm, the gauge tool comprising:
a plurality of mock-front-sights; and
a plurality of mock-rear-sights;

wherein each of the mock-front-sights corresponds to and replicates size and shape of at least one of the plurality of front-sights belonging to the collection of firearm sights; and wherein each of the mock-rear-sights corresponds to and replicates size and shape of at least one of the plurality of rear-sights belonging to the collection of firearm sights such that a user may visually determine which combination of each of the plurality of front-sights and each of plurality of rear-sights matches the user's vision; wherein the gauge tool comprises: an elongate body; a front-sight-array having two or more of the plurality of mock-front-sights; a rear-sight-array having two or more of the plurality of mock-rear-sights; and a front-coupling rotatably connecting the front-sight-array to the elongate body; and a rear-coupling rotatably connecting the rear-sight array to the elongate body; wherein the front-coupling and the rear-coupling rotate along the same axis, such that each of the plurality of mock-front-sights can be selectively aligned to each of the plurality of mock-rear-sights by manually rotating at least one of the front-sight-array and the rear-sight-array relative to the elongate body.

2. The system of claim 1, wherein the plurality of front-sights consists of four front-sights, each of the four front-sights being of differing sizes.

3. The system of claim 1, wherein the plurality of rear-sights consists of four rear-sights, each of the four rear-sights being of differing sizes.

4. The system of claim 1, wherein the front-sight-array comprises exactly four of the plurality of mock-front-sights, the four of the mock-front-sights being integrally connected to each other, the four of the mock-front-sights each being oriented perpendicularly to one another.

5. The gauge tool of claim 1, wherein the elongate body comprises a mock-firearm-frame which simulates the ergonomics of a semi-automatic handgun having a grip and a slide.

6. A clarified firearms sight and selection system, the system comprising:

a collection of firearm sights comprising
a plurality of front-sights; and
a plurality of rear-sight;

a gauge tool able to simulate a sighting arrangement on a firearm, the gauge tool comprising:
a plurality of mock-front-sights;
a plurality of mock-rear-sights;

wherein each of the mock-front-sights corresponds to and replicates size and shape of at least one of the plurality of front-sights belonging to the collection of firearm sights; and wherein each of the mock-rear-sights corresponds to and replicates size and shape of at least one of the plurality of rear-sights belonging to the collection of firearm sights;

such that a user may visually determine which combination of each of the plurality of front-sights and each of plurality of rear-sights matches the user's vision; wherein the gauge tool comprises: an elongate body; a front-sight-array having two or more of the plurality of mock-front-sights; a rear-sight-array having two or more of the plurality of mock-rear-sights; and a front-coupling rotatably connecting the front-sight-array to the elongate body; and a rear-coupling rotatably connecting the rear-sight array to the elongate body; wherein the front-coupling and the rear-coupling rotate along the same axis, such that each of the plurality of mock-front-sights can be selectively aligned to each of the plurality of mock-rear-sights by manually rotating at least one of the front-sight-array and the rear-sight-array relative to the elongate body;

wherein the plurality of front-sights comprises at least one clarified-front-sight, each clarified-front-sight-set comprising:

a front-sight-top-surface having a downward-forward taper;

a front-sight-left-surface having an inward-forward taper;

a front-sight-right-surface also having an inward-forward taper;

a front-sight-rear-surface; and a front-sight-bottom-surface having no taper, and including a front-fastening-mechanism; and wherein the plurality of rear-sights comprises at least one a clarified-rear-sight, each clarified-rear-sight comprising:

a u-channel formed by the combination of a rear-sight-base, a left-ear, and a right-ear;

wherein the left-ear comprises:

a left-ear-top-surface having a downward-forward taper;

a left-ear-left-surface having an inward-forward taper;

a left-ear-rear-surface; and a left-ear-right-surface also having an inward-forward taper; and wherein the right-ear comprises:

a right-ear-top-surface having a downward-forward taper;

a right-ear-left-surface having an inward-forward taper;

a right-ear-rear-surface; and a right-ear-right-surface also having an inward-forward taper.

7. The system of claim 6, further comprising a set of instructions.

* * * * *